US010517370B2

(12) United States Patent
Caulier et al.

(10) Patent No.: US 10,517,370 B2
(45) Date of Patent: Dec. 31, 2019

(54) APPLICATOR FOR APPLYING A COSMETIC PRODUCT

(71) Applicant: L'OREAL, Paris (FR)

(72) Inventors: Eric Caulier, Ferrieres (FR); Pauline Prade, Saint-Ouen (FR); Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 481 days.

(21) Appl. No.: 15/516,544

(22) PCT Filed: Oct. 2, 2015

(86) PCT No.: PCT/EP2015/072794
§ 371 (c)(1),
(2) Date: Apr. 3, 2017

(87) PCT Pub. No.: WO2016/050956
PCT Pub. Date: Apr. 7, 2016

(65) Prior Publication Data
US 2017/0238673 A1 Aug. 24, 2017

(30) Foreign Application Priority Data
Oct. 3, 2014 (FR) ..... 14 59527

(51) Int. Cl.
*A45D 34/04* (2006.01)
*A45D 40/20* (2006.01)
(Continued)

(52) U.S. Cl.
CPC ..... *A45D 34/04* (2013.01); *A45D 34/041* (2013.01); *A45D 40/20* (2013.01); *A45D 40/26* (2013.01);
(Continued)

(58) Field of Classification Search
CPC ..... A45D 2034/007; A45D 2040/0012; A45D 2200/1009; A45D 2200/1018;
(Continued)

(56) References Cited

U.S. PATENT DOCUMENTS 298,382 A * 5/1884 Holt ..... B43K 1/01 401/254
2,497,249 A * 2/1950 Weston ..... B43K 1/01 401/221
(Continued)

FOREIGN PATENT DOCUMENTS

EP 1 466 540 A1 10/2004
EP 1 669 003 A2 6/2006
(Continued)

OTHER PUBLICATIONS

Dec. 1, 2015 International Search Report issued in International Patent Application No. PCT/EP2015/072794.

*Primary Examiner* — Yogesh P Patel
*Assistant Examiner* — Jennifer F Gill
(74) *Attorney, Agent, or Firm* — Oliff PLC

(57) ABSTRACT

Applicator for applying a cosmetic product to the skin, in particular the eyelids, comprising an applicator member (10), the latter having on its external surface a recess (12) and an applicator tip (15) having a substantially flat main facet (20) extending from the recess (12) towards the distal end of the applicator member (10).

7 Claims, 6 Drawing Sheets

Figure 1:
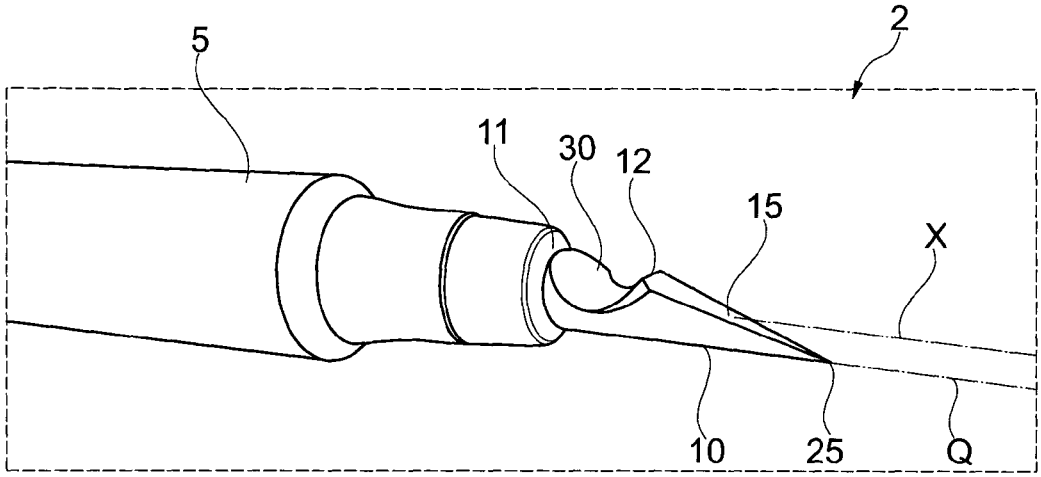

(51) Int. Cl.
*A45D 40/26* (2006.01)
*A45D 34/00* (2006.01)
*A45D 40/00* (2006.01)

(52) U.S. Cl.
CPC ..... *A45D 40/261* (2013.01); *A45D 2034/007* (2013.01); *A45D 2040/0012* (2013.01); *A45D 2040/204* (2013.01); *A45D 2200/1009* (2013.01); *A45D 2200/1018* (2013.01); *A45D 2200/1072* (2013.01)

(58) Field of Classification Search
CPC ..... A45D 2200/1072; A45D 2200/109; A45D 34/04; A45D 34/041; A45D 34/042; A45D 40/20; A45D 40/26; A45D 40/262; A45D 40/30; A61F 13/88; A61F 13/45; A61M 36/003; A61M 35/006; B05C 17/10; B43K 1/01; B43K 1/12; B43K 8/02; B43K 8/024; B44D 3/00; B44D 3/105; B44D 3/22
USPC ..... 132/320; 401/198–199; D19/115–116, D19/55
See application file for complete search history.

(56) References Cited

U.S. PATENT DOCUMENTS 2,622,560 A * 12/1952 Menaker ..... B43K 8/00 33/41.4
4,370,989 A 2/1983 Taylor
4,749,618 A * 6/1988 Kawaguchi ..... B43K 1/12 401/196
6,135,659 A * 10/2000 Ku ..... B05C 17/002 401/148
6,308,371 B1 * 10/2001 Forsline ..... B44D 3/00 132/320
6,508,255 B1 1/2003 Glover et al.
D591,904 S * 5/2009 Mongeon ..... D28/7
D643,068 S * 8/2011 Teague ..... D19/200
2007/0017544 A1 * 1/2007 Gueret ..... A45D 40/267 132/320
2007/0148114 A1 * 6/2007 Jager Lezer ..... A45D 40/262 424/70.7
2007/0181143 A1 * 8/2007 Montoli ..... A45D 40/262 132/320
2008/0185013 A1 * 8/2008 Abergel ..... A45D 34/04 132/200
2008/0213031 A1 * 9/2008 Castner ..... B43K 1/00 401/292
2008/0317542 A1 12/2008 Gueret
2011/0100866 A1 * 5/2011 Gueret ..... A45D 40/265 206/581
2012/0204899 A1 * 8/2012 Uehara ..... A45D 34/045 132/320
2012/0312315 A1 * 12/2012 Gueret ..... A45D 34/045 132/200
2014/0259416 A1 * 9/2014 Bourgraf, Jr. ..... A61G 13/0027 5/613
2015/0201737 A1 * 7/2015 Roualdes ..... A45D 40/265 132/200
2018/0110320 A1 * 4/2018 Berhault ..... A46B 3/18
2018/0325238 A1 * 11/2018 Cabon ..... A45D 34/04

FOREIGN PATENT DOCUMENTS

FR 2 412 287 A1 7/1979
FR 2 633 256 A1 12/1989
FR 2 917 584 A1 12/2008
FR 2 966 332 A1 4/2012
JP 2014-004084 A 1/2014
WO 99/55187 A2 11/1999

* cited by examiner

APPLICATOR FOR APPLYING A COSMETIC PRODUCT

The present invention relates to an applicator for applying a cosmetic product to the skin, in particular to the eyelids, and to a corresponding makeup method.

In order to draw a line on the eyelids, it is known to use makeup pencils.

Devices for making up the eyelids that comprise a reservoir containing the product to be applied and a flexible applicator member for applying the product, wherein the applicator member is separate from the reservoir, are also known, in particular from Patent Applications FR-A-2 633 256 and FR-A-2 412 287. In these devices, the applicator member is formed by a plastic tip which can be flocked or made of felt so as to retain the product, or else by a tip comprising capillary grooves for retaining the product. The applicator member can also be in the form of a fine brush.

A device comprising a reservoir and an applicator member having a tip, wherein the latter is supplied with the product from the container by compression of the walls of the container, is also known, in particular from U.S. Pat. No. 4,370,989.

With such devices, the user applies the tip loaded with product to one side of the eyelid, moving it as far as the other end, so as to draw a line in the same way as with a pencil.

However, it is relatively difficult to draw a regular line, in particular with a constant thickness along the entire length of the line. This is because the user tends to press more or less strongly on the tip while drawing the line, and so the tip is squashed to a greater or lesser extent against the eyelid. Consequently, the width of the tip applied to the eyelid, and thus that of the line drawn, varies. In the case of a fine brush, it is also quite difficult to obtain a fine line which is regular.

Moreover, it is very difficult to draw an identical line on both eyelids, since the user never presses in the same way. Specifically, the user is obliged either to change hands for each eyelid, with the result that the less skilful of the hands is used, or to use the same hand for both eyelids and to carry out two different movements.

Other types of applicator have been described for applying eyeliner compositions to the eyelids with different hand movements.

Application WO 99/55187 discloses a device for application to the skin, which is in the form of a pad having the shape of the desired design. The pad is supplied with cosmetic product by application of pressure to a reservoir.

Patent application EP 1 669 003 describes a device for packaging and applying a cosmetic product, comprising a container containing the product to be applied and a surface that delimits an opening, supplied with product from the container, and making it possible to form a design on the skin, in particular on the eyelids, without being moved over the skin.

U.S. Pat. No. 6,508,255 discloses an applicator for the eyelids, comprising two arms that are spaced apart at their distal end and are connected together by a stabilizing element that forms an applicator surface, the latter coming into contact with the skin, deforming to form the desired design in a single application.

Patent Application EP 1 466 540 relates to a device for applying and packaging a product which is in two parts that are connected together by a flexible applicator that comes into contact with the skin, one of the parts, forming a reservoir, containing the cosmetic product, and the other of the parts forming a cap for closing off an opening in the reservoir.

Patent applications FR 2 966 332 and JP 2014-4084 teach applicators comprising a flat application face which has a hole therethrough for dispensing the product to be applied.

Finally, Patent Application US 2007/0017544 describes an applicator for the lips, the skin or the nails and FR 2 917 584 teaches an applicator for the skin and the lips, both applicators comprising a flat applicator face and a recess adjacent to this applicator face.

These devices do not make it possible to obtain a great variety of different makeup results, do not adapt fully to the morphology of users' eyes and/or do not make it possible to produce particular effects in particular at the outer corner of the eye, in particular an upward flick that ends in a point.

There is a need to further improve makeup devices, in particular for the eyelids, and in particular to benefit from a device that adapts to the morphology of users' eyes while making it possible to obtain, if desired, a symmetrical makeup result on both eyes, and making it possible to easily finish off the line produced. There is also interest in a device that is capable of producing a rising outer flick effect in the outer corner of the eyes.

The invention aims to meet all or some of these needs by proposing an applicator for applying a cosmetic product to the skin, in particular the eyelids, comprising an applicator member, the latter having on its external surface a recess and an applicator tip having a substantially flat main facet extending from the recess towards the distal end of the applicator member.

In the following description, a front view of the main facet refers to a view of the main facet observed in direction facing the main facet. A side view of the applicator member refers to a view of the applicator member observed in a direction orthogonal to a longitudinal axis of thereof and parallel to the main facet.

The expression "applicator tip" is understood to mean a portion of the applicator that makes it possible to apply the cosmetic product and narrows both in terms of its thickness and its width.

By "a substantially flat main facet extending from the recess towards the distal end of the applicator member", it should be understood that the recess defines an edge of the main facet.

The abovementioned recess is preferably connected to the main facet by a ridge. This contributes to clearly delimit the application surface, thus improving the precision of application.

The recess is preferably bordered on one side by the main facet and formed on the other side by a set-back surface of the applicator.

The pointed shape of the applicator member allows precise application of the cosmetic product. It also makes it possible to finish off the line neatly and to easily produce an outer flick if so desired.

The main facet combined with the recess makes it possible to have an application surface of which the extent is relatively independent of the pressure applied by the user.

The detachment formed by the recess makes it possible to clearly define the application zone by creating a clean boundary between the application surface formed by the main facet and the rest of the applicator.

The recess is for example different from an opening through which a cosmetic product is dispensed.

Preferably, the width of the main facet decreases towards the distal end.

Also preferably, the main facet extends as far as the distal end. This allows precise application.

Preferably, the width of the applicator tip is more or less equal, along its entire length, to the width of the main facet.

Preferably, the main facet extends along the entire length of the applicator tip.

The main facet preferably has two rectilinear edges in front view that converge at the distal end of the applicator tip and form an angle β of preferably between 2° and 45°, better still between 5° and 45°, even better still between 15° and 30°, between one another The main facet may have a droplet-shaped or polygonal, in particular pentagonal or triangular overall shape in front view.

The applicator tip may have at least two, preferably more or less flat, side facets that each extend from the main facet towards the back of the applicator tip. The side facets are preferably inclined with respect to one another and form an angle δ of for example between 5° and 50° between one another in cross section.

The applicator tip may have, on its face away from the main facet, a back surface, for example comprising a convex surface, in particular defined by a cone or a cylinder portion, that forms the back of the applicator tip. This convex surface may be connected to the abovementioned side facets or to the side edges of the main facet. The back of the applicator tip may extend along a longitudinal axis that forms a non-zero angle ε in particular less than or equal to 10°, better still less than or equal to 5°, with the axis of the applicator member.

In a variant, the back of the applicator tip may extend along a direction parallel to the axis of the applicator member.

The back surface of the applicator may further comprise a notch.

The notch may have a rounded shape in side view.

Preferably, the notch is offset relative to the recess adjacent the main facet along the longitudinal axis of the applicator member. The notch may overlie with the recess over a length l lying preferably between 2 and 3 mm.

With the applicator member extending along a longitudinal axis, the main facet may extend along an axis inclined at an angle α, preferably between 0° and 60°, better still between 0° and 45°, even better still 2° and 25° relative to the longitudinal axis of the applicator member. This inclination may make it easier to apply the product to the skin, allowing the hand to be at a distance from the surface of the skin to be made up, in particular from the face.

The recess may extend around only a section around the longitudinal axis of the applicator tip.

In one variant, the recess extends all around the longitudinal axis of the applicator tip and can have a constant or non-constant cross section about said axis.

Preferably, in side view, the longitudinal axis of the main facet and the recess form an angle η of between 60° and 145°, better still between 80° and 130°, between one another at their junction.

The recess may form an indentation that extends from the main facet in the direction of the proximal end of the applicator member.

Preferably, the indentation does not extend as far as the proximal end of the applicator member.

More preferably, the indentation has a rounded shape in side view.

The thickness of the applicator member at the indentation is preferably between 0.5 mm and 10 mm, better still between 1 mm and 5 mm.

The applicator member may comprise, on its proximal side, a mounting end piece, it being possible for the latter to extend along the longitudinal axis of the applicator member.

The mounting end piece may be in the form of a cylinder of revolution and be received in a handle or reservoir.

The applicator member may be made of a porous material, in particular a felt.

The applicator member may be made of a mixture of polyamide and polyurethane resin, or of polyolefin, in particular of polyethylene.

The applicator member may be shaped by machining, in particular by grinding or laser machining.

The applicator member may be made of elastomer, in particular of SEBS or of polyester, for example Hytrel®.

The applicator member, notably the applicator tip, in particular the main facet, may be at least partially flocked.

The applicator may comprise a handle that is provided at its end with the applicator member.

The handle may be hollow and form a reservoir containing the product to be applied. As indicated above, the applicator member may comprise, on its proximal side, a mounting end piece, the latter preferably being inserted at least partially, and better still entirely, into an opening in the handle and extending at least partially into the reservoir.

The applicator member may be overmoulded on, or moulded together with, the handle.

The applicator tip may also extend from one end of the handle, it being possible for said end to extend, at its junction with the applicator tip, along an axis that forms a non-zero angle θ with the axis of the main facet, the angle θ being preferably between 20° and 90°, better still between 30° and 70°, even better still between 50° and 70°. The back of the applicator tip may extend along an axis that forms a non-zero angle λ with the axis of the end of the handle.

The end of the handle may be attached to the side of the applicator tip away from that of the main facet.

The applicator may comprise a closure cap that is attached to the handle and covers the applicator member.

The handle may be rectilinear. In a variant, the handle is curved, in particular bent in a plane.

The main facet may extend along a longitudinal axis and the axis of the main facet may be contained in the bending plane of the handle.

This length D of the applicator tip is preferably between 3 mm and 20 mm, better still between 5 mm and 15 mm.

The maximum width $l_{max}$ of the main facet is preferably less than or equal to 10 mm, better still between 2 mm and 5 mm.

Another subject of the invention is an assembly comprising an applicator according to the invention, as defined above, and a container containing the product to be applied, the container being separate from the applicator.

Another subject of the invention is a makeup method comprising the step of applying a cosmetic product onto the skin with the applicator according to the invention.

This method may comprise the step of applying the cosmetic product to the eyelids.

The product may be applied by dabbing the skin, in particular the eyelids, with the applicator.

In a variant, a line can be drawn on the skin, in particular the eyelids, with the applicator.

Preferably, the longitudinal axis of the main facet is positioned, during application, more or less parallel to the eyelid, the distal end of the applicator member being oriented towards the outside of the face. With this orientation, the tip of the applicator member can draw a pointed end of the line.

At the end of the line, the applicator may be inclined slightly upwards in order to form a flick towards the outside of the face.

Figure 2:
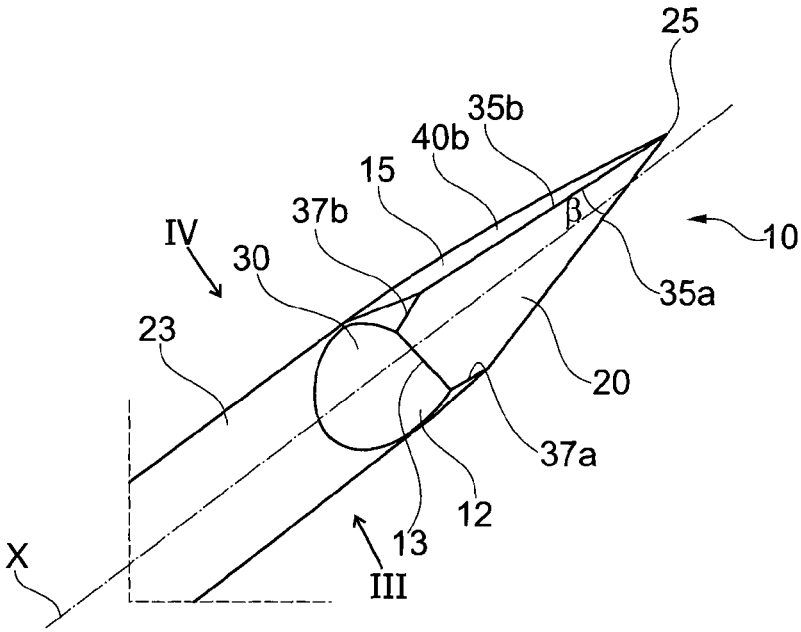
Figure 3:
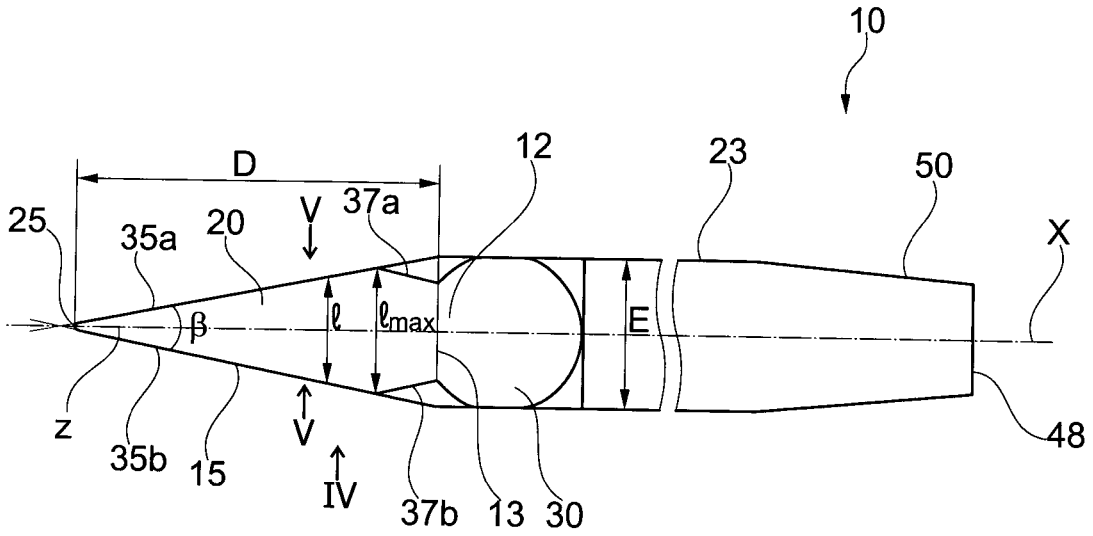
Figure 4:
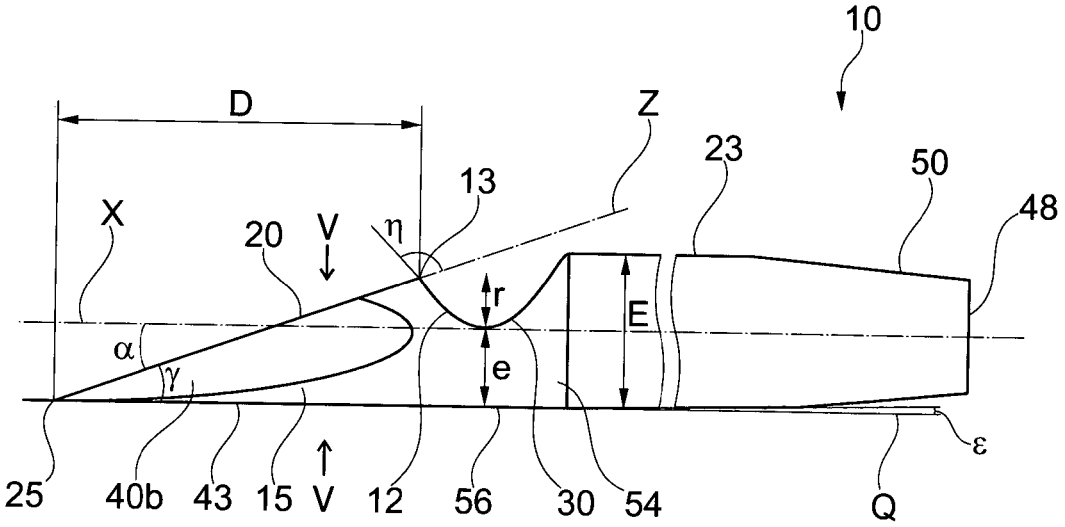
Figure 8:
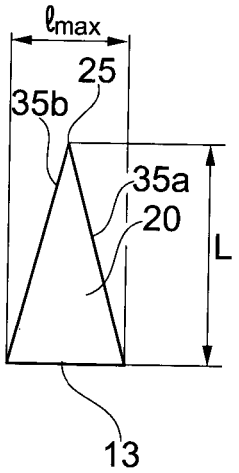
Figure 7:
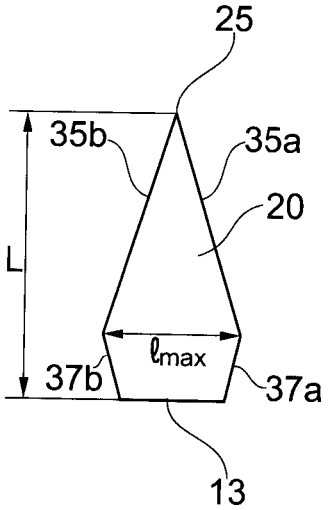
Figure 9:
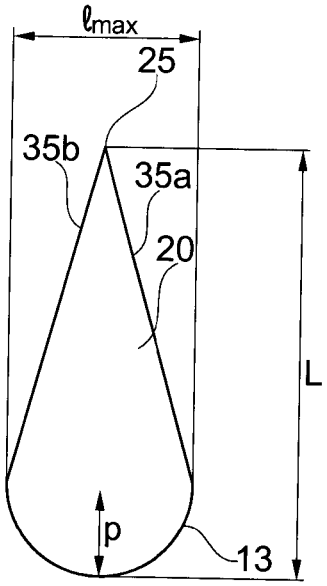
Figure 5:
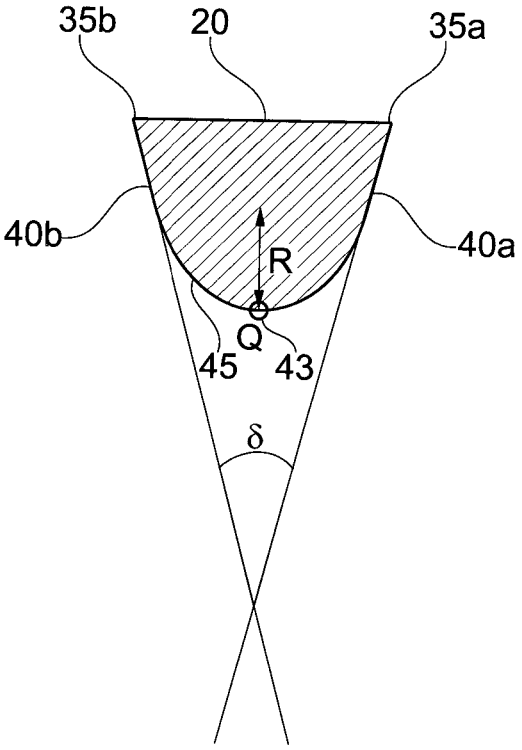
Figure 6:
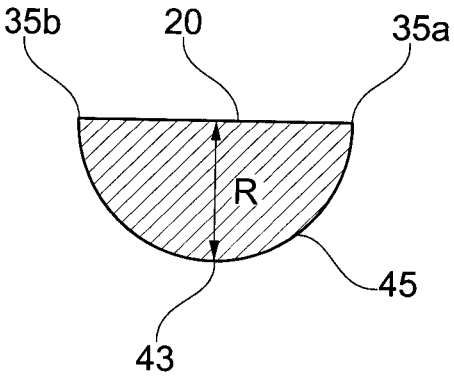
Figure 10:
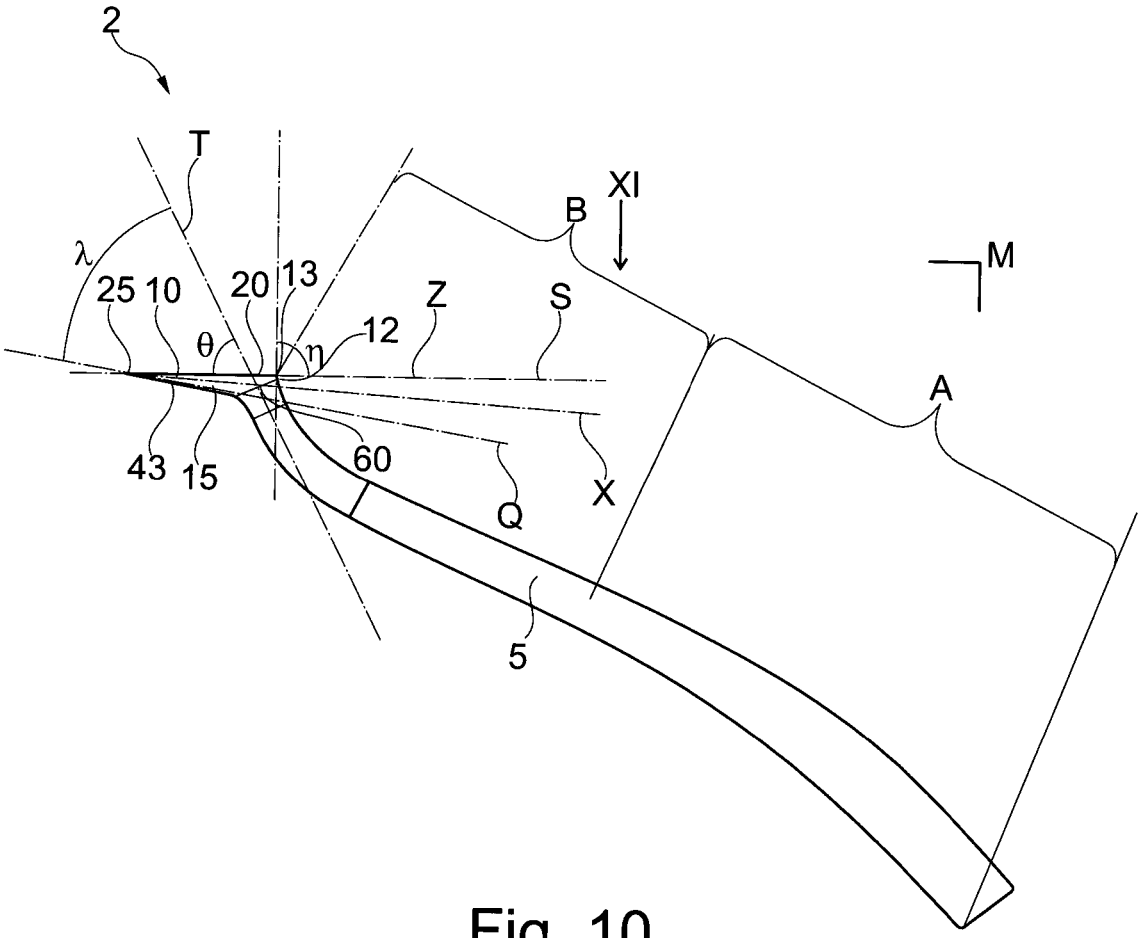
Figure 11:
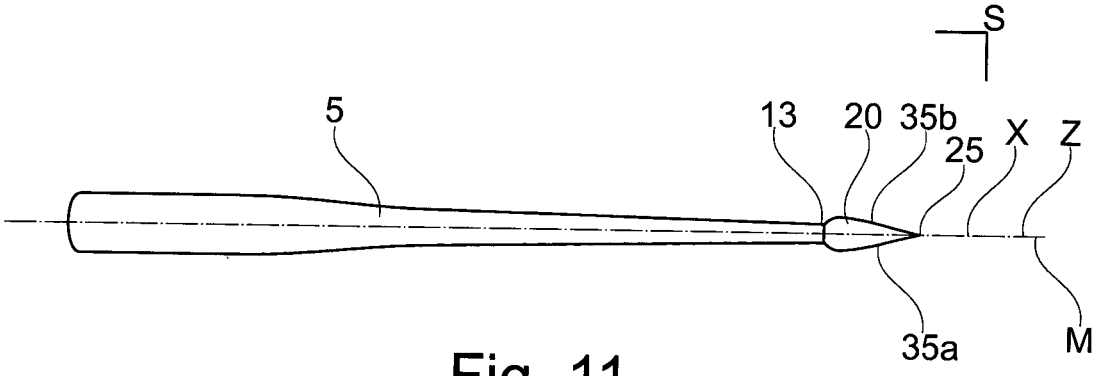
Figure 12:
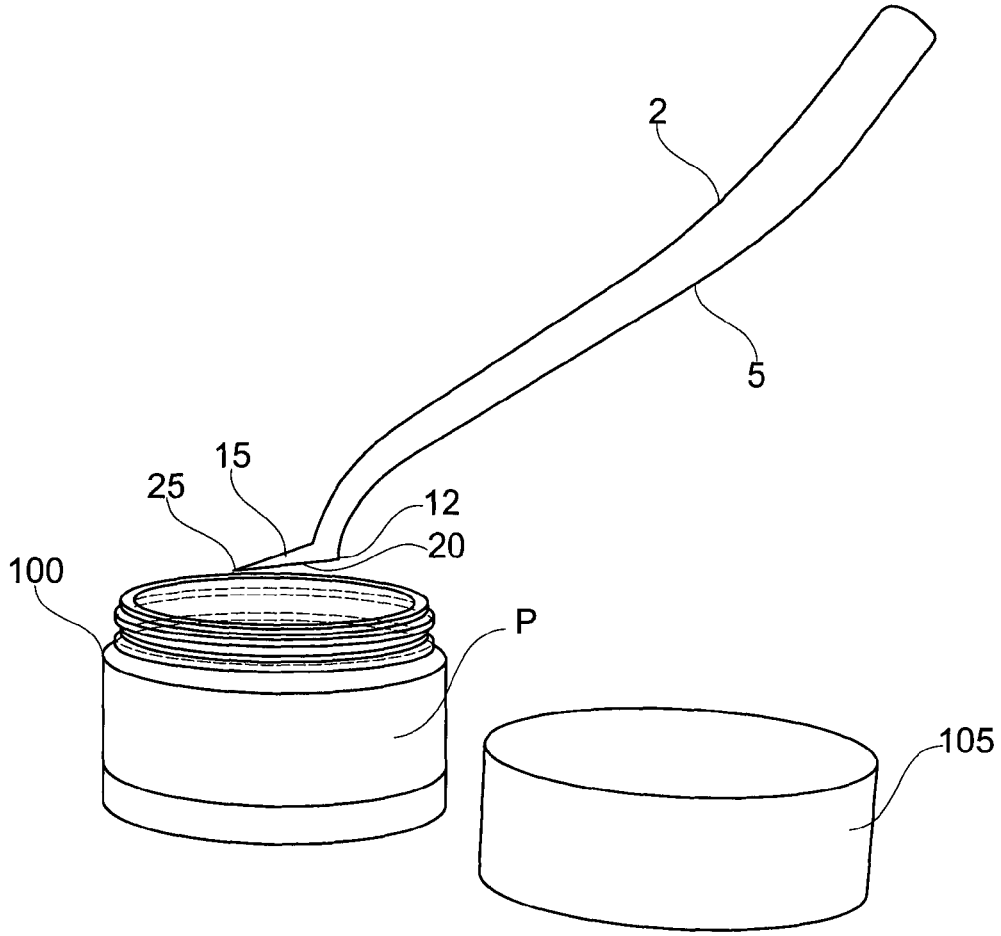
Figure 13:
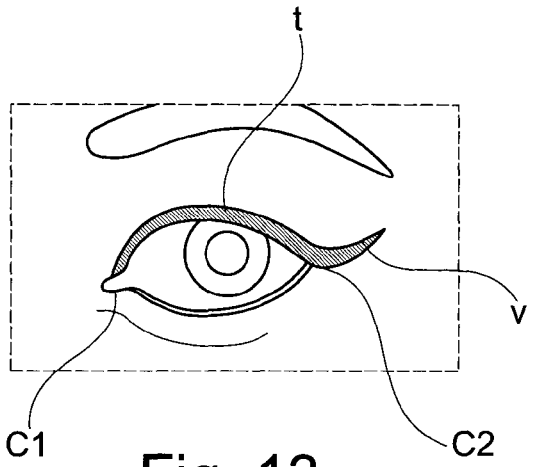
Figure 14:
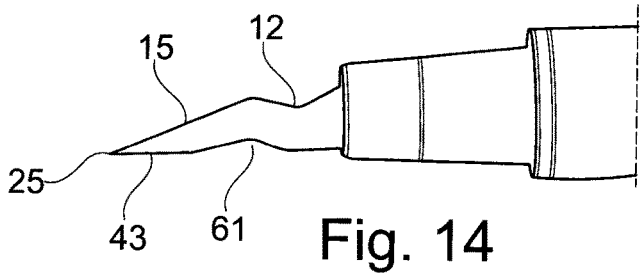
Figure 15:
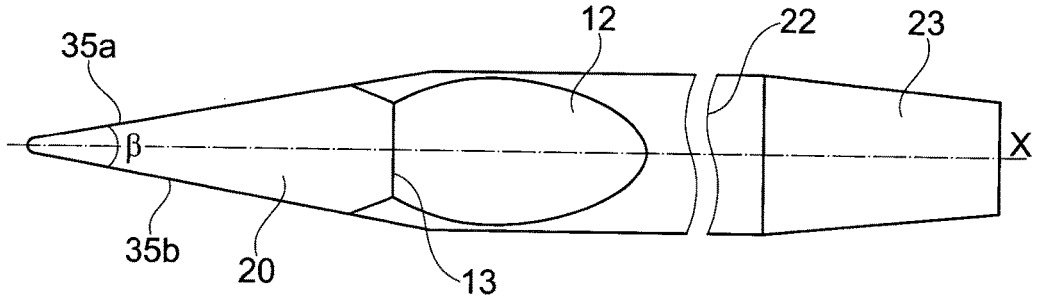
Figure 16:
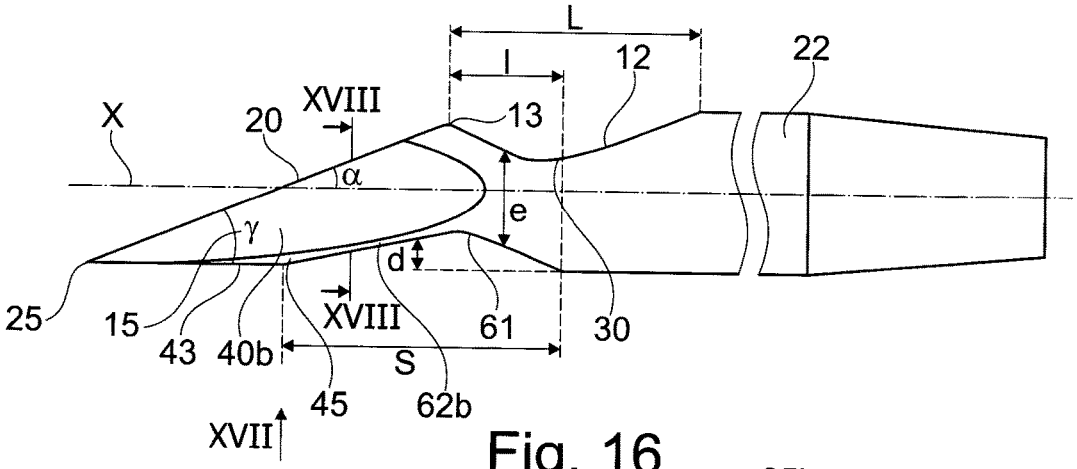
Figure 17:
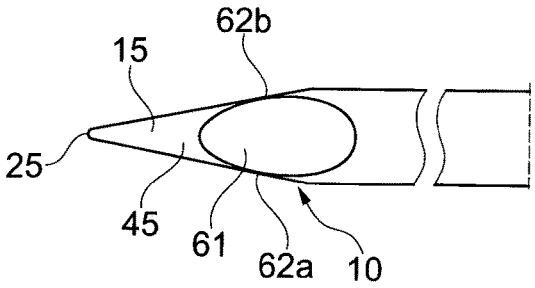
Figure 18:
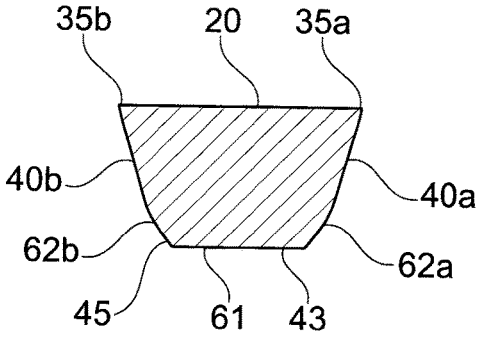

The invention may be better understood from reading the following detailed description of non-limiting illustrative embodiments thereof and from examining the appended drawing, in which:

FIG. 1 shows a perspective and partial view of an applicator according to the invention, FIG. 2 shows more particularly the applicator member of the applicator from FIG. 1, FIG. 3 is a partial view of the applicator member from FIG. 2 along the arrow III, FIG. 4 shows a side view of the applicator member along the arrow IV, FIG. 5 shows a cross-sectional view of the applicator tip on V-V in FIGS. 3 and 4, FIG. 6 is a view similar to FIG. 5 of a variant applicator tip according to the invention, FIG. 7 shows a front view of the main facet of the example in FIGS. 2 to 4, FIGS. 8 and 9 are views similar to FIG. 7 of variant main facets according to the invention, FIG. 10 schematically illustrates a side view of a variant applicator according to the invention, FIG. 11 is a top view along XI in FIG. 10, FIG. 12 shows an assembly according to the invention, FIG. 13 shows an example of a makeup result produced with the applicator according to the invention, FIG. 14 shows a perspective and partial view of another variant applicator according to the invention, FIG. 15 is a view similar to FIG. 3 of the applicator of FIG. 14, FIG. 16 is a view similar to FIG. 4 of the applicator of FIG. 14, FIG. 17 is back view of the applicator of FIG. 14, and FIG. 18 shows a cross-sectional view of the applicator tip along XVIII-XVIII of FIG. 15.

FIG. 1 shows an applicator 2 according to the invention, comprising a handle 5 and an applicator member 10 extending along an axis X.

Preferably, the handle 5 is rectilinear, but it may also be curved.

In the example in FIGS. 1 to 5, the handle 5 is hollow and contains the cosmetic product to be applied. The handle 5 acts as a reservoir.

The applicator member 10 comprises a mounting end piece 23 which is inserted into an opening 11 in the handle 5 and extends at least partially into the latter in order to be in contact with the cosmetic product.

The applicator member 10 is porous so as to allow the cosmetic product to reach, in particular by capillary action, the surface used for application.

The applicator member 10 is for example a porous material, in particular a felt.

The applicator member may be made of a mixture of polyamide and polyurethane resin, or of polyolefin, in particular of polyethylene.

The applicator may comprise a closure cap, not shown, that is attached to the handle 5 and thus covers the applicator member 10.

As illustrated more particularly in FIGS. 2 to 4, the applicator member 10 has, on its external surface, a recess 12 and an applicator tip 15 having a main facet 20. The latter extends from the recess 12 to the distal end 25 of the applicator member 10.

Preferably, the width l of the main facet 20 decreases towards the distal end 25 of the applicator tip 15, as can be seen in FIG. 2.

The width l of the main facet 20, at a given abscissa on the longitudinal axis X, can define, in front view, the width of the applicator tip 15.

The greatest width $l_{max}$ of the main facet 20 is preferably less than or equal to 10 mm, better still between 2 mm and 5 mm.

The length D of the applicator tip 15 is for example between 3 and 20 mm, better still between 5 mm and 15 mm.

Preferably, the main facet 20 is inclined relative to the longitudinal axis X. The main facet 20 extends along an axis Z that forms an angle $\alpha$ of preferably between 0 and 60°, better still between 0 and 45°, even better still between 2° and 45°, with the axis X.

As can be seen in FIGS. 2 and 3, the main facet 20 has two rectilinear main edges 35*a* and 35*b* that converge at the distal end 25 of the applicator tip 15 and form an angle $\beta$ of between 2° and 45°, better still between 5° and 45°, even better still between 15° and 30°, between one another. Preferably, the edges 35*a* and 35*b* are symmetrical with respect to the axis Z.

The main facet 20 can also comprise two rectilinear secondary edges 37*a* and 37*b* that each extend from one of the edges 35*a* or 35*b* to the recess 12.

Preferably, the main facet 20 is symmetrical with respect to its axis Z and can have a substantially triangular shape, as illustrated.

As can be seen in FIGS. 4 and 5, the applicator tip 15 can comprise two side facets 40*a* and 40*b* that extend from the main facet 20 to the back 43 of the applicator tip 15.

The width of the side facets 40*a* and 40*b* preferably decreases in the direction of the distal end 25. In cross section, as illustrated in FIG. 5, the side facets 40*a* and 40*b* converge in the direction of the back 43 of the applicator tip 15, forming an angle $\delta$ of preferably between 5 and 50° between one another.

The applicator tip 15 preferably has, on its face away from the main facet 20, a back surface 45. The back surface 45 can be an outwardly convex surface, for example a cone portion in the variant illustrated in the FIG. 5, that forms the back 43 of the applicator tip 15. This convex surface 45 is attached to the side facets 40*a* and 40*b*.

Preferably, the back 43 of the applicator tip 15 extends at its apex along an axis Q which is for example rectilinear and forms a cone generatrix with an angle $\varepsilon$ of less than or equal to 10°, better still less than or equal to 5°, with the axis X of the applicator member 10.

The applicator tip 15 forms an apex angle $\gamma$, the angle $\gamma$ being the angle formed between the axis Q of the back 43 of the applicator tip 15 and the axis Z of the main facet 20, being equal to $\alpha+\varepsilon$.

The recess 12 and the main facet 20 can form a ridge 13 between one another.

Preferably, the facet 20 and the indentation 30 form an angle $\eta$ of between 30° and 145°, better still between 80° and 130°, between one another, as illustrated in FIG. 4, at the recess 12.

Preferably, the indentation 30 has a rounded shape in side view, as illustrated in FIG. 4. The bottom of the indentation 30 has for example a radius of curvature r of between 0.5 mm and 3 mm, better still between 1 mm and 2 mm.

Preferably, the thickness e of the applicator member 10 at the bottom of the indentation is between 0.5 mm and 10 mm, better still between 1 mm and 5 mm.

Preferably, the ridge 13 is rectilinear, as can be seen in FIG. 3.

The mounting end piece 23 preferably has a shape substantially in the form of a cylinder of revolution, preferably with a chamfer 50 at its end to make it easier to introduce into the opening 11 in the handle 5.

The diameter E of the mounting end piece 23 is for example between 2 and 20 mm, in particular between 2 and 10 mm.

In the variant illustrated in FIG. 6, the applicator tip 15 does not have side facets. The convex surface 45 can then extend directly to the main edges 35*a* and 35*b* of the main facet 20.

In the example illustrated in FIG. 8, the main side edges 35*a* and 35*b* extend from the distal end 25 to the recess 12, such that the main facet 20 has a triangular shape.

In the example illustrated in FIG. 9, the main side edges 35*a* and 35*b* extend from the distal end 25 to the edge that delimits the recess 12. The ridge 13 has a curved shape, in particular a circular concave shape towards the proximal end 25 with a radius p of between 1 mm and 10 mm. The main facet 20 then has more or less the overall shape of a droplet.

In the variant illustrated in FIGS. 10 to 12, the handle 5 has a curved profile, being bent in a median plane M.

The handle 5 has a portion A of convex curvature towards the side of the main facet 20 and a portion B of concave curvature towards the side of the main facet 20, in the plane M.

Preferably, the applicator tip 15 extends, as illustrated, directly from the distal end 60 of the handle 5. Preferably, the applicator tip 15 is attached to the handle 5 by the back of its proximal part, such that the main facet 20 is on the side away from that of the handle 5.

The distal end of the handle 5 extends along a longitudinal axis T and the axis Z along which the main facet 20 extends can form an angle θ of between 20° and 90°, better still between 30° and 70°, even better still between 50° and 70°, with the axis T.

The recess 12 is bordered on one side by the applicator facet 20 and formed on the other by the distal end 60 of the handle 5.

The recess 13 presents a break of slope relative to the main facet 20. Preferably, in this example, the axis Q of the back of the applicator tip 15 forms an angle δ of between 10° and 90°, better still between 30° and 80°, with the axis T.

The handle 5 can be disposed entirely beneath the plane S of the main facet 20, such that the user is not impeded by his or her hand during the application of the cosmetic product.

The applicator member 10, better still the applicator 2, is preferably made of an elastomeric material, in particular of SEBS or polyester, and can be flocked on its surface.

The handle 5 does not contain the reservoir.

The product can be contained, as illustrated in FIG. 12, in a container 100 separate from the applicator 2.

The container 100 can be closed by a lid 105.

During use of the applicator 2, the user can dab his or her skin, or draw one or more lines with the applicator 2 until the desired makeup effect has been obtained.

For example, in the case of application to the eyelids, as illustrated in FIG. 13, the user can draw a line by applying the main facet 20 to the eyelid at the inner corner C1 of the eye and by moving it towards the outer corner C2 of the eye along the eyelid.

Preferably, the applicator 2 is held such that its applicator tip 15 is oriented towards the outside of the face, the axis Z of the main facet 20 being approximately parallel to the eyelid. Such handling makes it possible to finish off the line neatly, in particular to produce a rising flick V, as illustrated in FIG. 13, by orienting the applicator tip 15 slightly upwards at the end of the line, this flick V narrowing towards the outside of the face.

In the variant illustrated in FIG. 14, the applicator member 10 comprises a cylindrical proximal portion 22 adjacent to the endpiece 23. The recess 12 is bordered on one side by the cylindrical proximal portion 22, as can be seen in FIG. 16 and on the other side by the main facet 20, as illustrated in FIG. 15.

The back surface 45 comprises a cylinder portion in the variant illustrated in the FIG. 16. The back 43 of the applicator tip extends along a direction parallel to the axis of the applicator member X, i.e. $\gamma=\alpha$.

The applicator member 10 further differs from the variant illustrated in FIGS. 1 to 4 at least in the fact that the back surface 45 of the applicator member comprises a notch 61.

In a cross-section perpendicular to the axis X of the applicator member 10, the back surface 45 may have a shape of a truncated arc as illustrated in FIG. 18.

The notch 61 may have a rounded shape in a side view as illustrated in FIG. 16.

The notch 61 is preferably offset relative to the recess 12 so that over a length l of the applicator member 10 on which the notch 61 overlies with the recess 12, the thickness e of the applicator member 10 is substantially constant.

The length l lies preferably between 2 mm and 3 mm.

Preferably in a side view as represented in FIG. 16, the depth d of the notch relative to the back 43 of the applicator member 10 is such that the back surface 45 presents zones 62*a* and 62*b* of strip shape between the notch 61 and the respective side facets 40*a* and 40*b*.

Preferably, the length L of the recess 12, measured in a direction parallel to the longitudinal axis X of the applicator member 10, lies between 5.5 mm and 7 mm.

Preferably, the length S of the notch 61, measured in a direction parallel to the longitudinal axis X of the applicator member 10, lies between 6.5 mm and 7.5 mm.

The notch 61 preferably has droplet-shape when viewed from the back side of the applicator member 61, as illustrated in FIG. 17.

The invention is not limited to the examples which have just been described, the characteristics of which can be combined with one another as parts of variants which are not illustrated.

It is possible in particular to have a curved handle containing the product to be applied, the applicator having an applicator member made of a porous material or an applicator comprising a feed duct for product.

The expression "comprising a" is synonymous with "comprising at least one", unless specified to the contrary.

The invention claimed is:

1. Applicator for applying a eyeliner to the eyelid, comprising: an applicator member, the applicator member having on its external surface a recess and an applicator tip having a substantially flat main facet extending from the recess towards the distal end of the applicator member, wherein:

the applicator member being made of a porous material that is a felt, the main facet extending as far as the distal end, the applicator member extending along a longitudinal axis, the main facet extending along an axis at an angle α relative to the longitudinal axis, the angle α being between 0 and 45°, the width l of the main facet decreasing towards the distal end of the applicator member, the maximum width $l_{max}$ of the main facet being between 2 mm and 5 mm, the longitudinal axis Z of the main facet and the recess forming an angle η of between 30° and 145° between one another at their junction, the recess being connected to the main facet by a ridge, the applicator tip extending along a longitudinal axis, the recess extending all around the longitudinal axis of the applicator tip, the recess forming an indentation that extends from the main facet in the direction of a proximal end of the applicator member, the thickness e of the applicator member at the indentation being between 1 mm and 5 mm, the length D of the applicator tip being between 5 mm and 15 mm, the applicator tip having, on its face away from the main facet, a back surface that forms the back of the applicator tip, the applicator comprising a handle that is provided at its end with the applicator member, the handle being hollow and forming a reservoir containing the eyeliner, the applicator member comprising, on its proximal side, a mounting end piece, the mounting end piece of the applicator member being inserted at least partially into an opening in the handle and extending at least partially into the reservoir, the handle being rectilinear, the main facet extending along a longitudinal axis, the applicator tip extending from one end of the handle, the end of the handle extending, at its junction with the applicator tip, along a longitudinal axis, the main facet extending along an axis that forms a non-zero angle θ with the axis, and the applicator comprising a closure cap that is attached to the handle and covers the applicator member.

2. Applicator according to claim 1, wherein the main facet has two rectilinear edges in front view that converge towards the distal end of the applicator tip and form an angle β of between 2° and 45° between one another.

3. Applicator according to claim 1, wherein the recess has a constant cross section about the longitudinal axis of the applicator tip.

4. Applicator according to claim 1, wherein the main facet extends along the entire length of the applicator tip.

5. Applicator according to claim 1, the back surface being defined at least by a cone portion.

6. Applicator according to claim 1, the ridge being rectilinear.

7. Makeup method comprising the step of applying or dabbing a cosmetic product onto the skin with the applicator according to claim 1, the distal end being oriented towards the outside of the face or the applicator being inclined slightly upwards at the end of a line, in order to extend the line with a flick towards the outside of the face.

* * * * *